US007635949B2

(12) United States Patent
De Maagt et al.

(10) Patent No.: US 7,635,949 B2
(45) Date of Patent: Dec. 22, 2009

(54) COMPACT HIGH-PRESSURE DISCHARGE LAMP AND METHOD OF MANUFACTURING

(75) Inventors: Bennie Josephus De Maagt, Eindhoven (NL); Leo Gustaaf Joanna Emiel Marien, Turnhout (BE); Ronald Petrus Theodorus Kamp, Turnhout (BE); Claudio Boffito, Nerviano (IT)

(73) Assignee: Koninklijke Philips Electronics, N.V., Eindhoven (NL)

( * ) Notice: Subject to any disclaimer, the term of this patent is extended or adjusted under 35 U.S.C. 154(b) by 311 days.

(21) Appl. No.: 10/596,756

(22) PCT Filed: Dec. 23, 2004

(86) PCT No.: PCT/IB2004/052915

§ 371 (c)(1),
(2), (4) Date: Jun. 23, 2006

(87) PCT Pub. No.: WO2005/073998

PCT Pub. Date: Aug. 11, 2005

(65) Prior Publication Data

US 2007/0170862 A1 Jul. 26, 2007

(30) Foreign Application Priority Data

Jan. 5, 2004 (EP) ..... 04100004

(51) Int. Cl.
*H01J 17/24* (2006.01)

(52) U.S. Cl. ..... 313/553; 313/25

(58) Field of Classification Search ..... 75/245; 313/25, 553

See application file for complete search history.

(56) References Cited

U.S. PATENT DOCUMENTS

| | | | | |
|---|---|---|---|---|
| 5,037,342 | A * | 8/1991 | Barthelmes et al. | 445/22 |
| 5,432,399 | A * | 7/1995 | Nagasawa et al. | 313/25 |
| 6,521,014 | B2 * | 2/2003 | Toia et al. | 75/245 |
| 6,586,878 | B1 * | 7/2003 | Tu | 313/549 |
| 2002/0060520 | A1 * | 5/2002 | Niimi | 313/623 |

FOREIGN PATENT DOCUMENTS

JP 2004220880 A * 8/2004

OTHER PUBLICATIONS

English Translation JP 2004-220880 A.*

* cited by examiner

*Primary Examiner*—Nimeshkumar D. Patel
*Assistant Examiner*—Mary Ellen Bowman

(57) ABSTRACT

A high-pressure discharge lamp has an outer envelope (1) in which a discharge vessel (11) is arranged enclosing a discharge space (13) with an ionizable filling. The discharge vessel has two mutually opposed neck-shaped portions (2, 3) through which current supply conductors (4, 5) extend to a pair of electrodes (6, 7) in the discharge space. A lamp base (8) of electrically insulating material supports the discharge vessel. The lamp base also supports the outer envelope. The outer envelope with a volume equal to or less than 2 cc encloses the current supply conductors and is connected to the lamp base in a gas-tight manner. A getter (10) is provided in the outer envelope for pumping out residual nitrogen from the outer envelope after sealing off the discharge lamp prior to operation of the discharge lamp, the getter (10) comprising at least 2.5 mbar.ml nitrogen. Preferably, the getter comprises an alloy of zirconium and aluminum or of zirconium and cobalt.

14 Claims, 3 Drawing Sheets

COMPACT HIGH-PRESSURE DISCHARGE LAMP AND METHOD OF MANUFACTURING

Figure 1A:
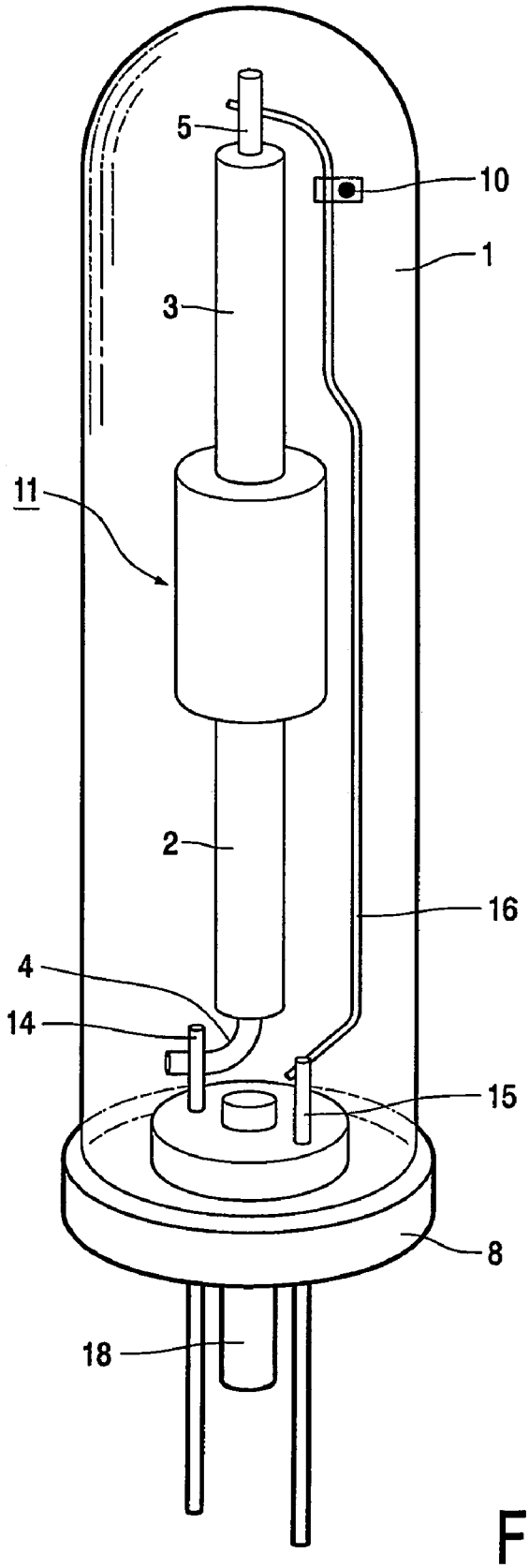

The invention relates to a high-pressure discharge lamp comprising an outer envelope in which a discharge vessel is arranged, the discharge vessel enclosing, in a gastight manner, a discharge space provided with an ionizable filling.

The invention also relates to a method of manufacturing a high-pressure discharge lamp.

High-pressure discharge lamps ranging from 35 to 150 W have become a dominant player in lighting retail applications. Trends have emerged which create positive conditions for range extensions towards lower lumen packages and/or lower wattages. Lower light levels are being used, for instance in exclusive shops, focusing the light on the goods instead of flooding the area. End users in the market become more and more interested in a uniform quality of the light and would prefer to employ high-pressure discharge lamps in stead of using halogen lamps for the low lumen packages and accent lighting.

Generally, high-pressure discharge lamps of the kind mentioned in the opening paragraph either have a discharge vessel with a ceramic wall or have a quartz glass discharge vessel. Such high-pressure discharge lamps are widely used in practice and combine a high luminous efficacy with favorable color properties. The discharge vessel of the lamp contains one or several metal halides in addition to Hg and a rare gas filling.

A ceramic wall of a discharge vessel in the present description and claims is understood to be a wall made from one of the following materials: mono-crystalline metal oxide (for example sapphire), translucent densely sintered polycrystalline metal oxide (for example $Al_2O_3$, YAG), and translucent densely sintered polycrystalline metal nitride (for example AlN).

A lamp of the kind mentioned in the opening paragraph is known from the German patent application DE-A 33 24 081. The heat budget of the known high-pressure discharge lamp with an electrical power consumption of less than 80 W is considerably improved if the discharge vessel is surrounded by a high quality vacuum. The high quality vacuum is at least $5.10^{-5}$ Pa and is produced by a bombardment getter whose outlet direction is directed at the lamp foot.

A disadvantage of the known high-pressure discharge lamp is that the manufacturing of the discharge lamp is relatively complicated.

The invention has for its object to eliminate the above disadvantage wholly or partly. According to the invention, a high-pressure discharge lamp of the kind mentioned in the opening paragraph for this purpose comprises:

an outer envelope in which a discharge vessel is arranged around a longitudinal axis, the discharge vessel enclosing, in a gastight manner, a discharge space provided with an ionizable filling, the discharge vessel having a first and a second mutually opposed neck-shaped portion through which a first and a second current supply conductor, respectively, extend to a pair of electrodes arranged in the discharge space, a lamp base of electrically insulating material supporting the discharge vessel via the first and second current supply conductors, the lamp base also supporting the outer envelope, the outer envelope enclosing the first and second current supply conductors, a getter being provided in the outer envelope, the outer envelope volume being equal to or smaller than 2 cc the getter comprising at least 2.5 mbar.ml nitrogen.

During manufacture of the high-pressure discharge lamp an atmosphere substantially comprising nitrogen is created in the outer envelope. As a next step the outer envelope is sealed in a gastight manner. After sealing the outer envelope and before igniting the discharge lamp, the residual nitrogen in the outer envelope is removed by activating the getter. The getter binds the residual nitrogen creating a vacuum in the outer envelope sufficient for ensuring a proper lamp operation during life of the high-pressure discharge lamp. By controlling the atmosphere in the outer envelope or outer bulb, the current supply conductors are well protected against oxidation.

In the known discharge lamp, the outer envelope is provided with a (glass) exhaust tube for pumping the residual gases from the outer envelope. Relatively long pumping times are needed to obtain the desired vacuum conditions in the outer envelope. Once the desired vacuum (level) is realized in the outer envelope the exhaust tube is sealed off. In addition, an outer envelope provided with a tipped off exhaust tube gives the high pressure discharge lamp an undesirable visual appearance. In practice it appeared that the removal of residual gases is relatively difficult for relatively small lamps, in particular for lamps having an outer envelope volume of equal or less than 2 cc.

In the high-pressure discharge lamp according to the invention the "pumping" of the outer envelope is achieved by activating the getter in the outer envelope. This pumping can be done in a relatively short period of time and before the discharge lamp is put in operation. By applying the getter the pumping mechanism can be done more effectively and faster compared to the conventional way of pumping. Subsequently, the getter remains active with respect to hydrogen, which may be released during lamp operation. The effectiveness of the getter is detected by measuring the nitrogen content of the getter material after activation using a thermal conductivity cell in combination with gas analyses (mass spectrometry). Typically, in as-received material before activation the getter is substantially free of nitrogen. After activation as described hereinabove the nitrogen content of the getter is at least 2.5 mbar.ml nitrogen.

In a preferred embodiment of the high-pressure discharge lamp according to the invention the getter comprises at least 5 mbar.ml nitrogen. In this manner vacuum conditions are realized in the outer envelope ensuring a long life of the high-pressure discharge lamp.

Using a getter for pumping the outer envelope avoids the provision of a tipped-off glass exhaust tube on the high-pressure discharge lamp. To this end, a preferred embodiment of the high-pressure discharge lamp according to the invention is characterized in that the outer envelope is free from a sealed exhaust tube.

By providing a getter binding nitrogen in the outer envelope during the manufacture of the high-pressure discharge lamp, a simplified and compact high-pressure discharge lamp can be made. In particular, the length of the high-pressure discharge lamp can be significantly reduced.

A preferred embodiment of the high-pressure discharge lamp according to the invention is characterized in that the material of the getter is selected from the group formed by yttrium, tantalum, niobium, titanium, thorium, hafnium, zirconium and vanadium. These materials effectively bind nitrogen during getter activation at relatively high temperatures. Preferably, the getter comprises an alloy of zirconium and aluminum or an alloy of zirconium and cobalt. These alloys of zirconium and aluminum or cobalt effectively bind nitrogen.

A very suitable place to mount the getter is close to the discharge vessel and close to the center of the outer envelope. To this end, in a favorable embodiment of the high-pressure discharge lamp according to the invention the getter is provided to a connection conductor connected to the second supply conductor and running alongside the discharge vessel.

In a preferred embodiment of the high-pressure discharge lamp according to the invention the lamp base comprises a tube for providing a nitrogen atmosphere in the outer envelope during manufacturing of the high-pressure discharge lamp. This has the advantage that the atmosphere in the outer envelope can be controlled via the tube after the discharge vessel and the outer envelope have been mounted on the lamp base of the high-pressure discharge lamp.

A preferred embodiment of the high-pressure discharge lamp according to the invention is characterized in that the lamp base is made from quartz glass, hard glass, soft glass or a ceramic material. Preferably, the lamp base is a sintered body, preferably, a glass, a glass-ceramic or a ceramic body. Preferably the base is colored whitish, so as to reflect extra light into usable beam angles, which increases the luminous efficacy of the lamp effectively. Preferably, the lamp base is in the form of a plate.

The lamp base can be manufactured with a high dimensional accuracy. It is favorable when the lamp base is plane at its surface facing away from the discharge vessel. This surface may be mounted against a (lamp) holder, for example a carrier, and accordingly is a suitable surface for serving as a reference for the position of the discharge vessel.

A preferred embodiment of the high-pressure discharge lamp according to the invention is characterized in that the outer envelope is fastened to the lamp base by means of an enamel. Preferably, the enamel is provided in the form of a previously shaped ring. Using a previously shaped ring largely simplifies the manufacturing of the high-pressure discharge lamp.

The high-pressure discharge lamp according to the invention has the advantage that when the lamp is in operation the discharge vessel has optically very compact virtual dimensions, which render the lamp highly suitable for use in compact luminaries.

The invention also relates to a method of manufacturing a high-pressure discharge lamp. According to the invention, a method of manufacturing a high-pressure discharge lamp, the high-pressure discharge lamp comprising:

an outer envelope in which a discharge vessel is arranged around a longitudinal axis, the discharge vessel enclosing, in a gastight manner, a discharge space provided with an ionizable filling, the discharge vessel having a first and a second mutually opposed neck-shaped portion through which a first and a second current supply conductor, respectively, extend to a pair of electrodes arranged in the discharge space, a lamp base of electrically insulating material supporting the discharge vessel via the first and second current supply conductors, the lamp base also supporting the outer envelope, the outer envelope enclosing the first and second current supply conductors, a getter being provided in the outer envelope, the outer envelope having a volume of equal or less than 2 cc, the method including:

activating the getter for reducing the amount of nitrogen in the outer envelope, after activation the getter comprising at least 2.5 mbar.ml nitrogen.

During manufacture of the high-pressure discharge lamp an atmosphere substantially comprising nitrogen is created in the outer envelope. As a next step the outer envelope is sealed in a gastight manner. After sealing the outer envelope and before the discharge lamp is ignited, the getter is activated, the getter reducing the amount of nitrogen in the outer envelope. The getter binds the residual nitrogen and creates a vacuum in the outer envelope sufficient for ensuring a proper lamp operation during life of the high-pressure discharge lamp. By controlling the atmosphere in the outer envelope or outer bulb, the current supply conductors are well protected against oxidation.

In the method of manufacturing a high-pressure discharge lamp the "pumping" of the outer envelope is achieved by activating the getter in the outer envelope. This pumping can be done in a relatively short period of time. Tests with a miniature getter have been carried out: after sealing, the residual nitrogen is removed by activating the getter by inductive heating. It was established, that all nitrogen can be removed when activating the getter during approximately half a minute. Subsequently, the getter remains active with respect to hydrogen, which may be released during lamp operation. The effectiveness of the getter is detected by measuring the nitrogen content of the getter material after activation using a thermal conductivity cell. Typically, in as-received material before activation the getter is substantially free of nitrogen. After activation as described hereinabove the nitrogen content of the getter is at least 2.5 mbar.ml nitrogen.

A preferred embodiment of the method of manufacturing a high-pressure discharge lamp is characterized in that after activation the getter comprises at least 5 mbar.ml nitrogen. In this manner vacuum conditions are realized in the outer envelope ensuring a long life of the high-pressure discharge lamp.

In a preferred embodiment of the method of manufacturing a high-pressure discharge lamp the material of the getter is selected from the group formed by yttrium, tantalum, niobium, titanium, thorium, hafnium, zirconium and vanadium.

Figure 1B:
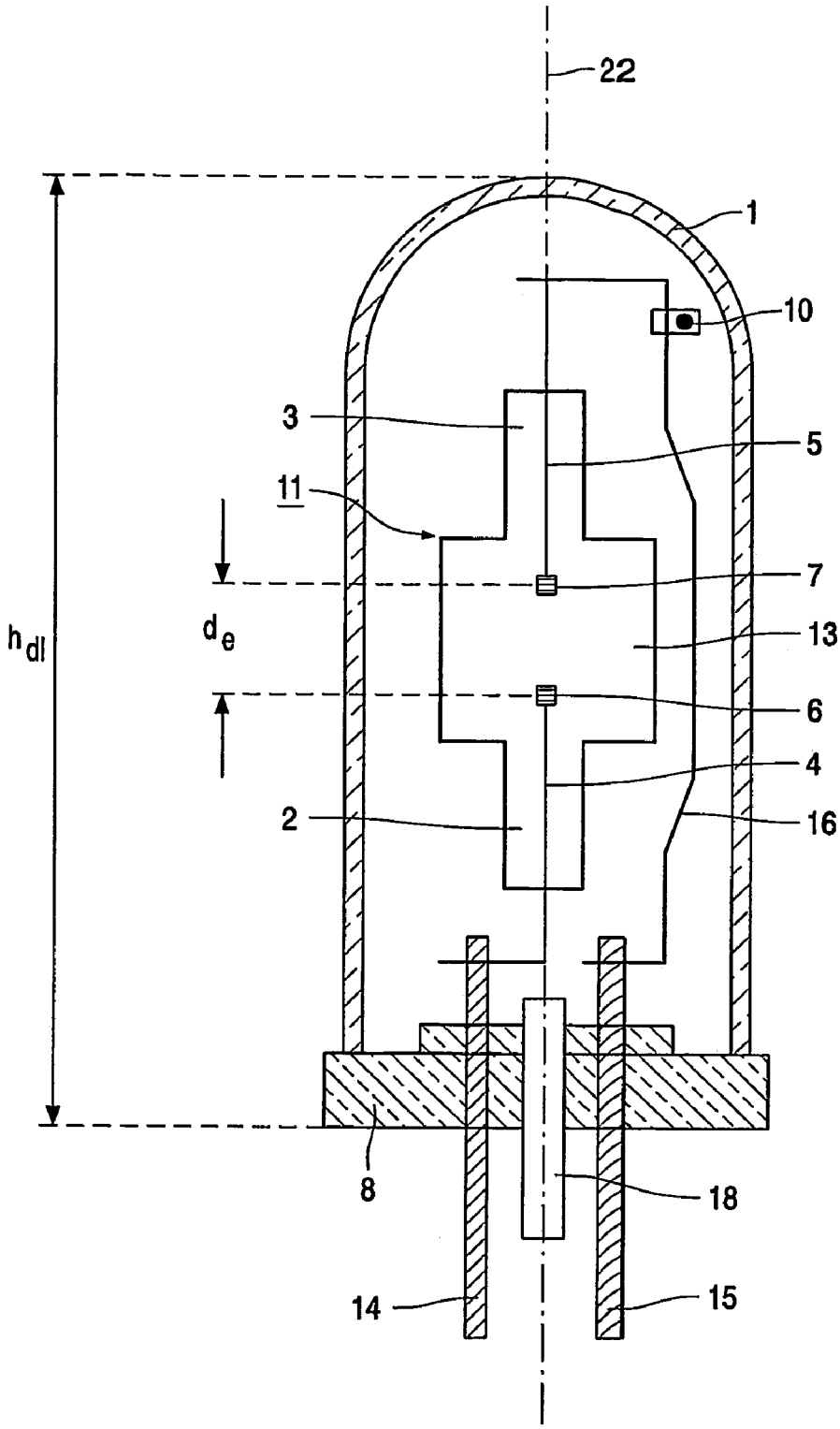
Figure 2:
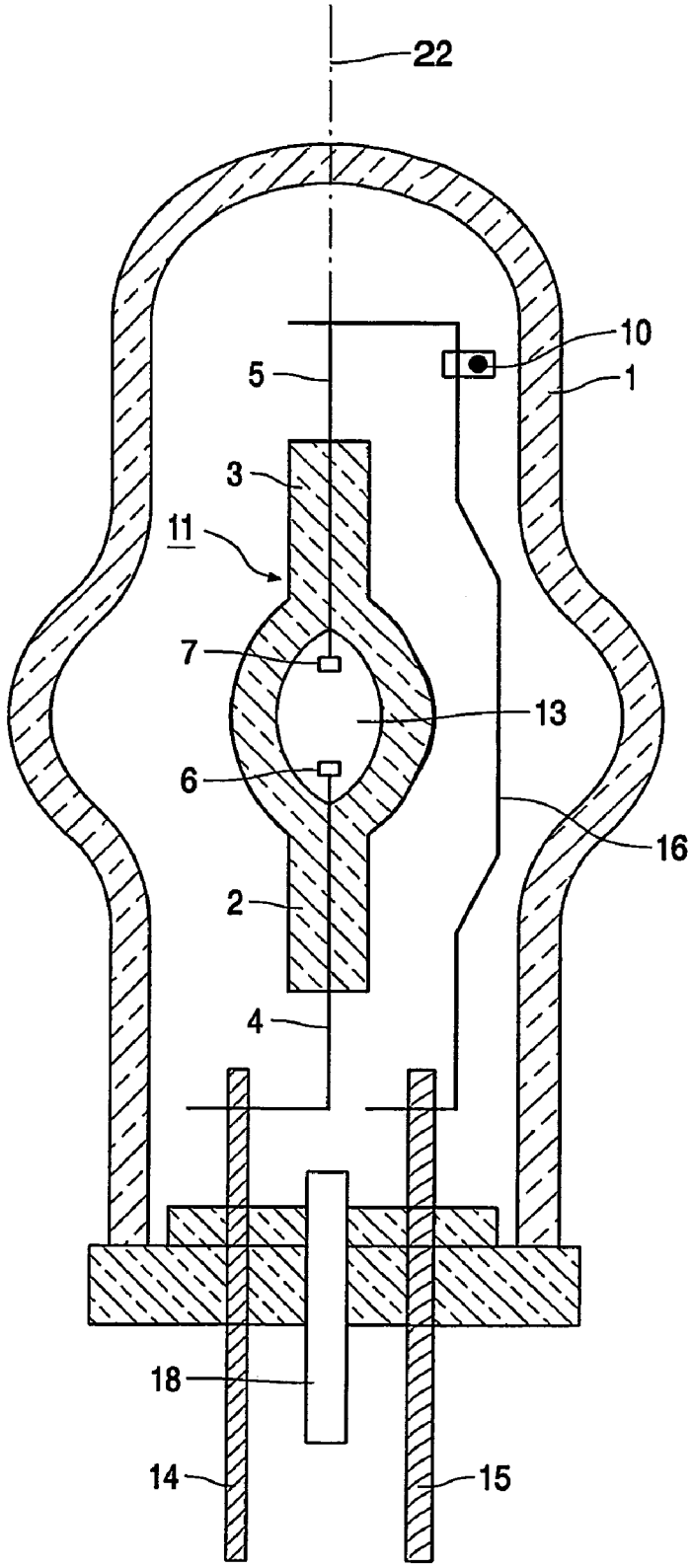

The invention will now be explained in more detail with reference to a number of embodiments and a drawing, in which:

FIG. 1A diagrammatically shows a high-pressure discharge lamp according to the invention;

FIG. 1B a cross-section of the high-pressure discharge lamp as shown in FIG. 1A, and FIG. 2 shows an alternative embodiment of the high-pressure discharge lamp according to the invention.

The Figures are purely diagrammatic and not drawn true to scale. Some dimensions are particularly strongly exaggerated for reasons of clarity. Equivalent components have been given the same reference numerals as much as possible in the Figures.

FIG. 1A shows an artists impression of a high-pressure discharge lamp according to the invention. FIG. 1B shows diagrammatically a cross-section of the high-pressure discharge lamp as shown in FIG. 1A. The high-pressure discharge lamp comprises a discharge vessel 11 arranged around a longitudinal axis 22. The discharge vessel 11 encloses, in a gastight manner, a discharge space 13 provided with an ionizable filling comprising mercury, a metal halide and a rare gas. In the example of FIGS. 1A and 1B, the discharge vessel 11 has a first neck-shaped portion 2 and a second mutually opposed neck-shaped portion 3 through which portions a first current supply conductor 4 and a second current supply conductor 5, respectively, extend to a pair of two electrodes 6, 7, which electrodes 6, 7 are arranged in the discharge space 13. The high-pressure discharge lamp is further provided with a lamp base 8 made from an electrically isolative material. The lamp base 8 supports the discharge vessel 11 via the first and second current supply conductors 4, 5. The lamp base 8 also supports an outer bulb or an outer envelope 1 with a volume of 2.0 cc. In the example of FIGS. 1A and 1B, the lamp base 8 is provided with a first contact member 14 which is connected to the first current supply conductor 4. In addition, the lamp base 8 is provided with a second contact member 15 connected to the second supply conductor 5 via a connection conductor 16 running alongside the discharge vessel 11.

In an alternative embodiment, at least one contact member is formed by a feed through tube in the lamp base, allowing one of the current supply conductors to be fastened in said feed through tube. Alternatively two feed through tubes may be provided in the lamp base. The fastening in these feed through tubes may be done by resistance, laser welding or crimping. An advantage of the use of feed through tubes in stead of the contact members is that more freedom of positioning the discharge vessel on the longitudinal axis of the high-pressure discharge lamp is attained. This may further improve the precise positioning of the discharge vessel in the outer envelope of the high-pressure discharge lamp.

The outer envelope 1 is connected to the lamp base 8 in a gas-tight manner. By controlling the atmosphere in the outer envelope, the current supply conductors 4, 5 are well protected against oxidation. By preventing oxidation of the current supply conductors 4, 5, the current supply conductors 4, 5 can be positioned relatively close to the discharge vessel 11. By controlling the atmosphere is the outer envelope, press seals and/or tipped-off (quartz) tabulations can be avoided resulting in a simplified and compact high-pressure discharge lamp. Preferably, a tube 18 for providing a nitrogen atmosphere in the outer envelope 1 during manufacture of the high-pressure discharge lamp is provided in the lamp base 8. After sealing off the tube 18, a nitrogen atmosphere remains in the outer envelope 1. In the known discharge lamp, the outer envelope is provided with a (glass) exhaust tube for pumping the residual gases from the outer envelope. Relatively long pumping times are needed to obtain the desired vacuum conditions in the outer envelope. Once the desired vacuum (level) is realized in the outer envelope the exhaust tube is sealed off. In addition, an outer envelope provided with a tipped off exhaust tube gives the high-pressure discharge lamp an undesirable visual appearance. It is advantageous if the tube 18 in the lamp base 8 is made from a metal or from a NiFeCr alloy.

In the high-pressure discharge lamp according to the invention the "pumping" of the outer envelope 1 is achieved by activating a getter 10 comprising an amount of getter material of 10 mg in the outer envelope 1. This pumping can be done in a relatively short period of time and before the discharge lamp is put in operation. Subsequently, the getter 10 remains active with respect to hydrogen, which may be released during lamp operation. After activation as described hereinabove the nitrogen content of the getter 10 is at least 2.5 mbar.ml nitrogen.

A very suitable place to mount the getter 10 is close to the discharge vessel 11 and close to the center of the outer envelope 1. Preferably, the getter 10 is provided to a connection conductor 16 connected to the second supply conductor 5 and running alongside the discharge vessel 11.

Preferably, the material of the getter is selected from the group formed by yttrium, tantalum, niobium, titanium, thorium, hafnium, zirconium and vanadium. These materials effectively bind nitrogen at the temperatures during getter activation (750-900° C.). In a very favorable embodiment the getter 10 comprises as getter material 10 mg of an alloy of zirconium and aluminum or an alloy of zirconium and cobalt. These alloys of zirconium and aluminum or cobalt effectively bind nitrogen. Suitable active materials for the getter 10 are Zr—Al (St101 from SAES) and Zirconium-Cobalt-mixed metal alloy (St787 from SAES). Typically, in as-received material before activation less than 1 mbar.ml nitrogen is found; after activation the content is typically 20 mbar.ml nitrogen (10 mbar N2 in a volume of 2 cc).

The lamp base 8 is preferably made from quartz glass, hard glass, soft glass, glass-ceramic or a ceramic material. In addition, the lamp base 8 is provided as a sintered body, preferably, a sintered ceramic body. Preferably, the lamp base 8 is in the form of a plate. The lamp base 8 can be manufactured with a high dimensional accuracy. The lamp base 8 has the additional advantage that it can be made in a light color, for example white or a pale grey. By employing a material with a light color, light emitted by the discharge vessel 11 will be reflected into usable beam angles, thereby increasing the efficiency of the luminaire or the total efficiency of the high-pressure discharge lamp. It is prevented thereby that the light incident on the lamp base 8 is lost to the light beam which may be formed by means of a reflector. In addition, it is favorable when the lamp base 8 has a (flat) plane at its surface facing away from the discharge vessel 11. This surface may be mounted against a (lamp) holder, for example a carrier, for instance a reflector, and accordingly is a suitable surface for serving as a reference for the position of the discharge vessel 11. In another favorable embodiment, the surface of the lamp base 8 facing the discharge vessel has a central elevation, which serves to center the discharge vessel 11 and enamel ring with respect to the lamp base 8 during the manufacture of the high-pressure discharge lamp.

Preferably, the outer envelope 1 is made from quartz glass, hard glass or soft glass. The outer envelope 1 is, preferably, fastened to the lamp base 8 by means of an enamel of (glass) frit. It is favorable when the enamel is provided in the form of a previously shaped ring. Using such a previously shaped ring largely improves the accuracy of the positioning of the discharge vessel 11 during the manufacture of the high-pressure discharge lamp. The choice of the enamel depends on the material of the outer envelope 1 and on the material of the lamp base 8.

In the example of FIGS. 1A and 1B, a substantially cylindrical outer envelope 1 is provided. FIG. 2 shows an alternative embodiment of the high-pressure discharge lamp according to the invention in which the discharge vessel 11 is made from quartz. In this embodiment the ionizable filling in the discharge space comprises mercury, a metal halide and a rare gas. In the example of FIG. 2, part of the outer envelope is provided in a substantially spherical form.

By providing a getter 10 binding nitrogen in the outer envelope 1 during the manufacture of the high-pressure discharge lamp, a simplified and compact high-pressure discharge lamp can be made. In particular, the length of the high-pressure discharge lamp can be significantly reduced.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A high-pressure discharge lamp comprising:

an outer envelope in which a discharge vessel is arranged around a longitudinal axis, the discharge vessel enclosing, in a gastight manner, a discharge space provided with an ionizable filling, the discharge vessel having a first and a second mutually opposed neck-shaped portion through which a first and a second current supply conductor, respectively, extend to a pair of electrodes arranged in the discharge space, a lamp base of electrically insulating material supporting the discharge vessel via the first and second current supply conductors, the lamp base also supporting the outer envelope, the outer envelope enclosing the first and second current supply conductors, a getter being provided in the outer envelope, and outside the discharge vessel, the outer envelope having a volume equal to or less than 2 cc, and the getter comprising at least 2.5 mbar.mil nitrogen.

2. A high-pressure discharge lamp as claimed in claim 1, wherein the getter comprises at least 5 mbar.mil nitrogen.

3. A high-pressure discharge lamp as claimed in claim 1 or 2, wherein the material of the getter is selected from the group formed by yttrium, tantalum, niobium, titanium, thorium, hafnium, zirconium and vanadium.

4. A high-pressure discharge lamp as claimed in claim 1 or 2, wherein the getter comprises an alloy of zirconium and aluminum or a zirconium-cobalt-mixed metal alloy.

5. A high-pressure discharge lamp as claimed in claim 1, wherein the material of the getter is provided to a connection conductor connected to the second supply conductor and running alongside the discharge vessel.

6. A high-pressure discharge lamp as claimed in claim 1, wherein the outer envelope is free from a sealed exhaust tube.

7. A high-pressure discharge lamp as claimed in claim 1, wherein the lamp base comprises a tube for providing a nitrogen atmosphere in the outer envelope during manufacturing of the high-pressure discharge lamp.

8. A high-pressure discharge lamp as claimed in claim 7, wherein the tube is made from a metal or from a NiFeCr alloy.

9. A high-pressure discharge lamp as claimed in claim 1, wherein the lamp base is made from quartz glass, hard glass, soft glass, glass-ceramic or a ceramic material.

10. A high-pressure discharge lamp as claimed in claim 1, wherein the outer envelope is fastened to the lamp base by an enamel.

11. A method of manufacturing a high-pressure discharge lamp, the compact high-pressure discharge lamp comprising:

an outer envelope in which a discharge vessel is arranged around a longitudinal axis, the discharge vessel enclosing, in a gastight manner, a discharge space provided with an ionizable filling, the discharge vessel having a first and a second mutually opposed neck-shaped portion through which a first and a second current supply conductor, respectively, extend to a pair of electrodes arranged in the discharge space, a lamp base of electrically insulating material supporting the discharge vessel via the first and second current supply conductors, the lamp base also supporting the outer envelope, the outer envelope enclosing the first and second current supply conductors, a getter being provided in the outer envelope, and outside the discharge vessel, the outer envelope having a volume equal to or less than 2 cc, and the method including:

activating the getter for reducing the amount of nitrogen in the outer envelope, and after activation of the getter comprising at least 2.5 mbar.mil nitrogen.

12. A method of manufacturing a high-pressure discharge lamp as claimed in claim 11, wherein the material of the getter is selected from the group formed by yttrium, tantalum, niobium, titanium, thorium, hafnium, zirconium and vanadium.

13. A method of manufacturing a high-pressure discharge lamp as claimed in claim 11 or 12, wherein the getter is activated by inductive heating.

14. A method of manufacturing a high-pressure discharge lamp as claimed in claim 11 or 12, wherein the getter is active as getter for hydrogen during life of the discharge lamp.

* * * * *